United States Patent [19]

Wild

[11] 4,112,431

[45] Sep. 5, 1978

[54] RADIATORS FOR MICROWAVE AERIALS

[75] Inventor: John Paul Wild, Strathfield, Australia

[73] Assignee: Commonwealth Scientific and Industrial Research Organization, Campbell, Australia

[21] Appl. No.: 694,128

[22] Filed: Jun. 8, 1976

[30] Foreign Application Priority Data

Jun. 9, 1975 [AU] Australia ..... PC1921

[51] Int. Cl.[2] ..... H01Q 3/26

[52] U.S. Cl. ..... 343/768; 343/770

[58] Field of Search ..... 343/771, 770, 768, 767

[56] References Cited

U.S. PATENT DOCUMENTS

| | | | |
|---|---|---|---|
| 2,566,703 | 9/1951 | Iams | 343/755 |
| 3,039,098 | 6/1962 | Bickmore | 343/771 |
| 3,172,113 | 3/1965 | Heinard et al. | 343/771 |

*Primary Examiner*—Alfred E. Smith
*Assistant Examiner*—David K. Moore
*Attorney, Agent, or Firm*—Sughrue, Rothwell, Mion, Zinn and Macpeak

[57] ABSTRACT

A microwave radiator in the form of a parallel plate transmission system with an array of radiating slots in one plate is used to transmit scanning planar radio beams. The radiating structure is shaped to form part or the whole of a cylindroid. The array of slots may be on the convex or concave side of the radiator, which is preferably curved in the plane of the axis of the beam. Scanning through 360° is possible with a full cylindroid radiator having the array of slots extending over all its convex surface.

8 Claims, 7 Drawing Figures

RADIATORS FOR MICROWAVE AERIALS

Figure 1:
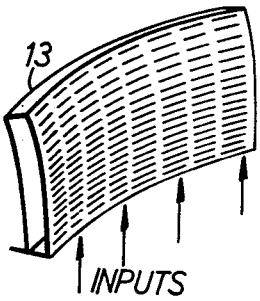

This invention concerns radiators for microwave aerials used to generate scanned ratio beams.

The specification of my U.S. Pat. No. 3,878,523 describes aerial configurations which may be used to generate scanned, planar radio beams. Each of those configurations incorporates an arc of microwave feed elements located essentially at the half-radius of curvature of a substantially cylindrical reflector. For high precision microwave landing systems, however, the size of that aerial structure must be such that the region of the reflector illuminated by any one of the microwave feed elements is a good approximation to a parabola. For economic reasons it is desirable to minimise the size of the aerial structure without loss of signal resolution, and various ways of doing this, including modifications of the aerial or the signal modulation techniques used with it, have been proposed. The present invention is a part of a further approach to the problem of maintaining high accuracy signals while reducing aerial size and costs, namely the provision of a radiator which enables a new type of aerial for generating scanning planar radio beams to be produced.

More particularly, the present invention is a microwave radiator which is shaped to be part or the whole of a cylindroid surface. (Note: within this specification the term "cylindroid" is defined as the curved surface of a substantially cylindrical body.) Radiation may be from either the concave or the convex side of the radiator, which is typically supplied with microwave energy by a feed system involving parallel plate transmission lines. This new type of aerial can be made smaller than the aerial of the type described in aforementioned U.S. Pat. No. 3,878,523, and still exhibit the same beamwidth and side-lobe quality. Alternatively, if constructed to a similar overall size as an aerial of that type, it will generate a beam substantially reduced in its angular width.

One particular embodiment of the present invention, an aerial having a radiator which is a completely cylindroid surface, radiating from its convex side, can be used to generate planar radio beams which can be scanned through 360°. Typically such aerials will be used to generate azimuth signals for aircraft navigation and landing systems.

According to the present invention, a radiator for a microwave aerial for generating scanning planar radio beams comprises a parallel plate microwave transmission system which (i) is shaped to be part or the whole of a cylindroid, and (ii) has a two-dimensional array of slots in one of its parallel plates, whereby microwave energy in the form of a planar radio beam may be transmitted by the radiator.

The parallel plates of the radiator may be formed into or constructed as a plurality of slotted waveguides extending parallel to the axis of symmetry of the aerial which extend parallel to the rotational axis of the cylindroid. Alternatively, dividing walls may extend in sections in the same direction within the slotted parallel plate system, or may form a hybrid structure which is in part a slotted parallel plate transmission system and in part a slotted waveguide.

In the present invention, the curvature in the plane of the rotational axis of the cylindroid assists in the vertical shaping of the beam in the plane containing that axis.

Figure 2:
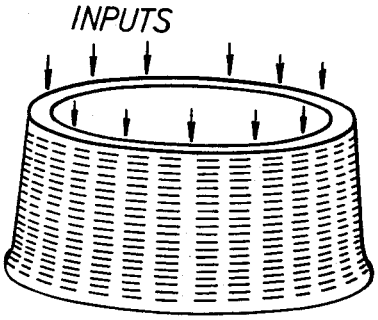
Figure 3:
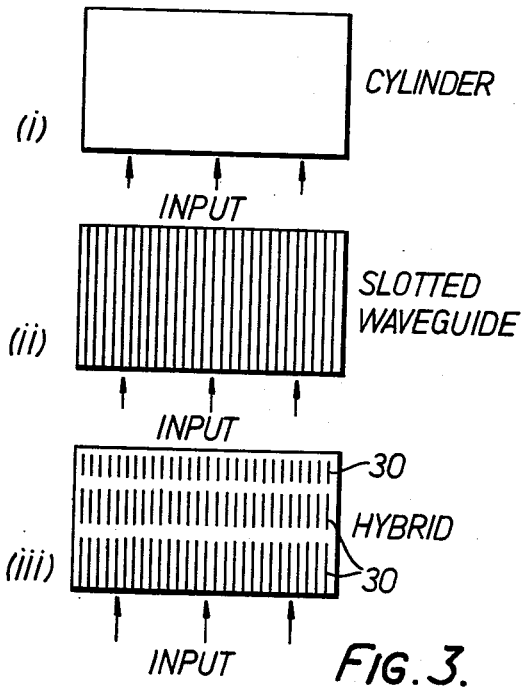
Figure 4:
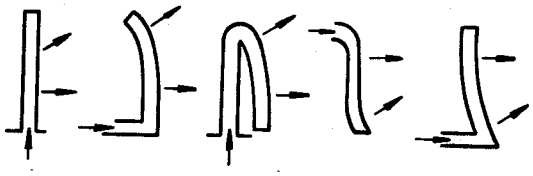
Figure 5:
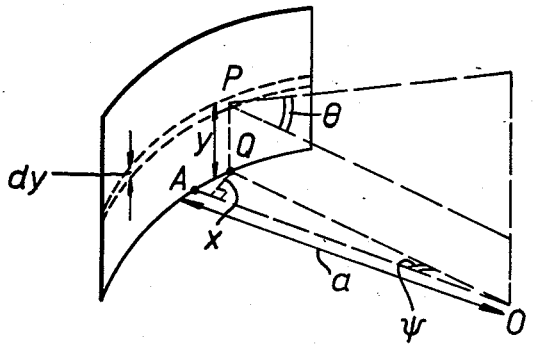
Figure 5:
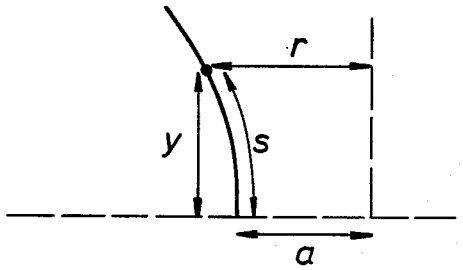
Figure 6:
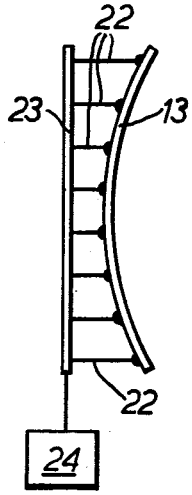
Figure 7:
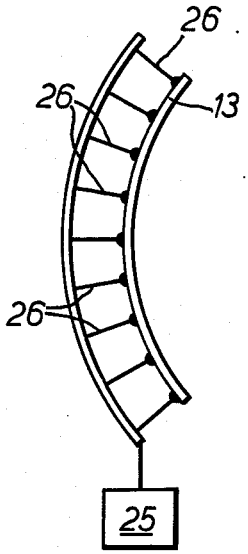

To explain the present invention further, various embodiments thereof will now be described with reference to the accompanying drawings of which:

FIG. 1 illustrates a radiator consisting of a concave system for the generation of planar radio beams having restricted azimuth coverage, FIG. 2 depicts a radiator a convex radiating system for scanning through 360°, FIG. 3 shows three types of parallel plate construction for the radiator, FIG. 4 shows examples of the radial sections through radiators of the present invention, and, illustrates various ways in which the aerial may be curved to influence the vertical shape of the transmitted planar radio beam, FIG. 5 comprises two diagrams used to demonstrate the way in which radiators may be curved to influence vertical shaping of the transmitted radiation, and FIGS. 6 and 7 illustrate monitoring arrangements that may be used with aerials of the present invention.

The aerial of FIG. 1, energy from an input feed system is fed to a concave radiator 13 consisting of a series of curved, abutting, slotted waveguides each having a one-dimensional array of slots formed therein, from which microwave energy will radiate.

With uniform spacing of the slots, if the waveguides were not curved and if the signals radiated from all the slots in each waveguide were in phase, a pencil beam would be produced which, with commutative switching of the inputs, could be scanned in a horizontal plane. To obtain a planar beam of predetermined vertical shape from this aerial, it is necessary, in accordance with one embodiment of the present invention, to use curved waveguides as shown in FIG. 4 and to vary the phase, or amplitude and phase, of the emergent radiation along the waveguide. If $\theta$ is the angle of elevation, the radius of curvature in the horizontal direction should be increased by a factor of sec $\theta$ to expand the beam in the vertical direction. As this is an important concept in the shaping of the planar radio beam transmitted by an aerial constructed in accordance with the present invention, the mathematical basis for the sec $\theta$ factor will be explained in more detail, with reference to FIG. 5, in a section included towards the end of this specification.

The slotted waveguide embodiment described above is the presently preferred construction of the aerials of the present invention. It is shown schematically as part (ii) of FIG. 3. However, it is also possible to have a cylindroidal radiating element comprising a pair of parallel plates with the plate from which energy is radiated containing a two-dimensional array of slots. Externally, this type of aerial, featured schematically as part (i) of FIG. 3, would look like the slotted waveguide aerial, and in operation it is essentially the same as the slotted waveguide construction, except that the energy within the aerial diverges as it passes through the radiating element.

Another alternative aerial construction, illustrated in part (iii) of FIG. 3, is a combination of the two types of radiator described above. Vertical conducting walls 30 are included within the parallel plates of the radiator. These waveguide walls effectively "freeze" the divergence of the excited radiation travelling through the radiation element. Where the waveguide walls are absent, the radiation can resume its normal divergence. This type of structure can be used with advantage where sharp cut-off of the planar beam is required at or near the horizon.

It will be clear to those skilled in this art that radiators of the types described above can be used, as shown in FIG. 2 (and as modified with reference to FIG. 4), with a dielectric disc or R2R aerial feed systems to provide a 360° scanned planar radio beam aerial.

An advantage of aerials constructed in accordance with the present invention is that their accuracy and power transmission level can be readily monitored. With a concave aerial, the transmitted power can be sampled by a detector located at the centre of curvature of the cylindroid, in a similar manner to the monitoring of power levels in aerials of the type described in the aforementioned U.S. Pat. No. 3,878,523. To monitor the accuarcy of the scanning of the present aerials, however, both concave and convex aerials may use the systems illustrated in FIGS. 6 and 7.

FIG. 6, which specifically illustrates a concave aerial system, shows a "central beam" monitoring arrangement comprising a series of "bleeds" of the input radiation through cables 22 which have lengths to compensate for the distances between the upper rim of the feed system and the plane wavefront. The signal samples "bled off" are combined in a transmission line or waveguide 23, which is connected to a processor 24. As the scanned beam passes precisely through the central point of its scan, all the "bled off" signals add in phase and a peak is registered in the processor 24 (typically a conventional airborne receiver and processor). The correct timing of the peak can then be monitored. In a similar manner, by appropriate adjustment of the cable lengths of the "bleeds", the beams transmitted in other directions may be monitored.

To monitor the aerial comprehensively, for all directions of a concave aerial, the system illustrated schematically in FIG. 7 may be used. In this embodiment, the signal in the aerial is sampled at corresponding points in the radiator 13 and is added without phase change (i.e., each sampling cable 26 is of the same length) and the resultant phase is compared with the phase of the signal from the transmitter in a phase comparator 25. By this technique, the time between transmissions of power at a predetermined angle off-axis of the aerial can be accurately measured, for the vector representing the sum of the individual signals rotates as the effective centre of the radiating aperture moves (in the course of scanning). Hence the accuracy of the scanning beam may be checked throughout the coverage zone with high sensitivity. It is interesting to note that the distance between sampling points in this system is typically one wavelength, but increasing this distance to slightly more than one wavelength has the effect of "stretching" the vector of the added signals so that more of the aerial aperture contributes to the monitored signal.

MATHEMATICAL CONSIDERATION

In formulating design criteria for aerials constructed in accordance with the present invention, the approach that is recommended is summarised by the following steps:

1. It will be assumed that each horizontal element of the aerial is constrained to radiate at an elevation angle $\theta$, which changes smoothly as the element selected moves up the aerial.
2. A single horizontal element of the aerial is then considered, and is given a shape such that the phase is correct along its entire length for radiation at angle $\theta$.
3. It is then comfirmed that two neighbouring elements have the correct phase gradient at their centres to radiate at elevation angle $\theta$.
4. Finally, the radiation at selected elevation angles is weighted by allocating more of the vertical extent of the aerial to those elevations requiring the strongest radiated signal.

To demonstrate these steps, reference will be made to FIG. 5 and it will be assumed that it is required to cause a horizontal circular arc element of the radiator, having thickness $dy$, to radiate a plane wave, the wavefront of which lies on a plane tilted upwards by an angle $\theta$. The excess phase path which must be applied at the radiating element (i.e., at point A in FIG. 5) is $P$, which is given by the expression:

$$P = \alpha (\cos \psi - 1). \cos \theta.$$

If the cylindrical surface containing the radiating element $dy$ is replaced by a surface of revolution which is curved vertically in such a manner that its radius of curvature in the horizontal plane, $r$, follows the equation $$r = \alpha \sec \theta,$$

then P is independent of $\theta$ and only the correct curvature of the aerial in a horizontal plane has to bechosen to obtain the required beam shaping.

As far as weighting the signals in specified directions is concerned, if the vertical power pattern of the radiating beam is $f(\theta)$, the generating curve (in the vertical direction) must be chosen so that it satisfies the relationship:

$$ds/d\theta = k.f(\theta)$$

If, for example, $$f(\theta) = \operatorname{cosec}^2\theta \ (\theta_1 \leqq \theta \leqq \theta_2) = 0 \text{ (elsewhere)},$$

$$\text{then } -s = k(\cot \theta_1 - \cot \theta)$$

and $$-r^2 = a^2\{1 + \frac{1}{(\cot \theta_1 - \frac{s}{k})} 2\}$$

(In practice, $s$ can be replaced by $y$ with negligeable error for $\theta_2 \leqq 20°$).

It is, of course, necessary to also ensure that the radiated vertical phase distribution along the vertical line at X =0 satisfies the requirement that the introduced vertical phase distribution is such that $$\left\{\begin{matrix}\text{the angle introduced}\\ \text{by the tilted normal}\\ \text{to the surface}\end{matrix}\right\} + \left\{\begin{matrix}\text{the angle introduced}\\ \text{by the vertical}\\ \text{phase}\end{matrix}\right\} = \theta.$$

If the angles concerned are sufficiently small to be indistinguishable from their tangents, then the vertical phase distribution, $P_y$, is given by $$\frac{dr}{dy} + \frac{d(-P_y)}{dy} = \theta.$$

from this expression, $$P_y = r - \int \theta \cdot dy$$

$$= r - y \cot^{-1} \frac{y}{(k)} + \frac{k}{2} \ln (y^2 + k^2)$$

$$+ \theta_1 k \cot \theta_1 + k \ln (\sin \theta_1).$$

ANALYSIS OF PERFORMANCE

Computations to evaluate the above theory havebeen made for an array of curved radiators forming a cylindroid surface with a radius a of 40λ. The array was designed to radiate a beam having a horizontal half-power width of 1° at low elevation angles. In the vertical plane the pattern was shaped to provide coverage up to an elevation angle of 20°, with very sharp cut off at low elevation angles. The theoretical performance of this array was compared with that of a right cylindrical array of straight radiators with the same radius and designed to provide the same specified beam shape.

Up to an elevation angle of 10°, both types of radiators produced patterns with the specified horizontal beamwidth of 1°. At higher elevation angles, the width of the beam from the array of straight radiators increased progressively to a value of 2.5° at 20° elevation angle. For the array of curved radiators, the horizontal beamwidth did not exceed 1.3° anywhere in the elevation angle range.

What I claim is:

1.A radiator for a microwave aerial for generating scanning planar radio beams comprising, a conducting parallel plate transmission system, said parallel plate shaped as at least a segment of a cylindroid, said cylindroid having an axis of generation, a regular two-dimensional array of slots in one of its parallel plates, said array comprising a columnar arrangement of slots, each slot having its long dimension in a plane perpendicular to the axis of generation of the cylidroid, and aperture means between one pair of parallel concentric edges of said plates, through which aperture means microwave power is fed into the parallel plate structure for transmission therethrough, the microwave power emerging from the slots in a plurality of adjacent columns of the array, forming a planar radio beam, the plane of said radio beam being coplanar with the axis of the cylindroid, whereby distributed microwave excitation moves around said aperture means and is effective to cause the planar radio beam to scan about the axis of generation of the cylindroid.

2. A radiator as defined in claim 1, in which the slotted parallel plate portion thereof is constructed as a plurality of slotted waveguides extending parallel to the axis of symmetry of the aerial.

3. A radiator as defined in claim 1, in which the slotted parallel plate portion thereof has dividing walls extending in sections in the same direction within the parallel plates, thereby producing a combination structure which is in part the parallel plate transmission system and in part a slotted waveguide.

4. A radiator as defined in claim 1, in which the parallel plate transmission system is shaped as a cylindroid and the 2-dimensional array of slots is formed in the parallel plate on the concave side thereof.

5. A radiator as defined in claim 1, in which the 2-dimensional array of slots is formed in the parallel plate on the convex side thereof.

6. A radiator as defined in claim 1, in which the slotted parallel plate portion thereof is curved in the plane of the axis of the transmitted radio beams to assist the vertical shaping of the beams.

7. A radiator as defined in claim 6, in which the said curvature applied to the slotted parallel plate portion is such that, in the case of an azimuth signal aerial, the radius of curvature in the horizontal direction is a function of sec $\theta$, where $\theta$ is the angle of elevation.

8. A radiator as defined in claim 1, including a signal monitoring arrangement which monitors the occurrence of the transmission of a predetermined beam of radiation comprising, a plurality of signal sampling points located at corresponding positions on the parallel plate, a single transmission line, connections between said transmission line and each of said sampling points, and a signal processor coupled to said transmission line and each connection between a sampling point and the single transmission line being of such a length that when the predetermined beam is being radiated from the radiator, the signal samples arrive at the single transmission line in phase and a peak is registered by the signal processor.

* * * * *